United States Patent [19]

Burk et al.

[11] Patent Number: 4,642,125

[45] Date of Patent: Feb. 10, 1987

[54] CARBONACEOUS MATERIAL AND METHODS FOR MAKING HYDROGEN AND LIGHT HYDROCARBONS FROM SUCH MATERIALS

[75] Inventors: Maksymilian Burk; Jack L. Blumenthal, both of Los Angeles, Calif.

[73] Assignee: TRW Inc., Redondo Beach, Calif.

[21] Appl. No.: 557,405

[22] Filed: Nov. 30, 1983

Related U.S. Application Data

[63] Continuation of Ser. No. 248,597, Mar. 27, 1981, abandoned, which is a continuation-in-part of Ser. No. 99,789, Dec. 3, 1979, abandoned, which is a continuation-in-part of Ser. No. 917,240, Jun. 20, 1978, abandoned, which is a continuation-in-part of Ser. No. 817,647, Jul. 21, 1977, abandoned.

[51] Int. Cl.[4] ..... C10J 3/00

[52] U.S. Cl. ..... 48/197 R; 48/203; 60/39.02; 423/657

[58] Field of Search ..... 48/197 R, 203, 210; 423/459, 648 R, 657, 658; 60/39.02; 585/733

[56] References Cited

U.S. PATENT DOCUMENTS

| | | | |
|---|---|---|---|
| 2,686,819 | 8/1954 | Johnson | 260/670 |
| 2,704,293 | 3/1955 | Kratzer | 260/450 |
| 3,031,287 | 4/1962 | Benson et al. | 48/197 R |
| 3,615,298 | 10/1971 | Benson | 48/197 |
| 3,619,142 | 11/1971 | Johnson | 23/214 |
| 3,700,422 | 10/1972 | Johnson et al. | 48/197 |
| 3,816,609 | 6/1974 | Hamner | 423/655 |
| 4,134,907 | 1/1979 | Stephens, Jr. | 260/449.6 M |
| 4,211,669 | 7/1980 | Eakman et al. | 252/373 |
| 4,242,103 | 12/1980 | Rabo et al. | 585/733 |
| 4,242,104 | 12/1980 | Frost et al. | 48/197 R |
| 4,265,868 | 5/1981 | Kamody | 423/415 A |
| 4,284,416 | 8/1981 | Nahas | 48/197 R |

FOREIGN PATENT DOCUMENTS

| | | | |
|---|---|---|---|
| 0004456 | 3/1979 | European Pat. Off. | 585/733 |
| 294759 | 4/1928 | United Kingdom | 423/404 |
| 2002726B | 2/1979 | United Kingdom . | |

OTHER PUBLICATIONS

Renshaw et al, "Disproportionation of CO Over Cobalt and Nickel Single Crystals", Journal of Catalyzers, 22, pp. 394, 395, 401, 403, 409, 410; 1971.

Emmett, P. H., "Catalysis", Reinhold Publishing Corp., vol. IV, 1956, pp. 434–511.

Gasior et al., Production of Synthesis Gas . . . Process, Int. Bu. of Mines, Pgh., Pa., about 1961.

Gilliand et al., "Reactivity of Deposited Carbon", I&E Chem., vol. 46, No. 10, Oct. 1954, pp. 2195–2202.

McKee, Douglas, "Effect of . . . Hydrogen", Carbon, 1974, vol. 12, pp. 453–464, Pergammon Press.

Walker et al., "Carbon Formation . . . I. Properties of Carbon Formed", J. Phys. Cherry, vol. 63, pp. 133–140 (2/59).

Walker et al., "Carbon Formation . . . II. Rates of Carbon Formation", J. Phys. Chem., vol. 63, pp. 140–149 (2/1959).

*Primary Examiner*—Peter Kratz

*Attorney, Agent, or Firm*—Jeffrey G. Sheldon; Benjamin DeWitt

[57] ABSTRACT

Carbonaceous materials comprising major amounts of carbon, and minor amounts of hydrogen and ferrous group metal components, particularly nickel and cobalt, react with steam at low temperatures, and produce commercially attractive quantities of such gases as hydrogen, methane, carbon oxides and other light hydrocarbons.

30 Claims, 11 Drawing Figures

Figure 1:
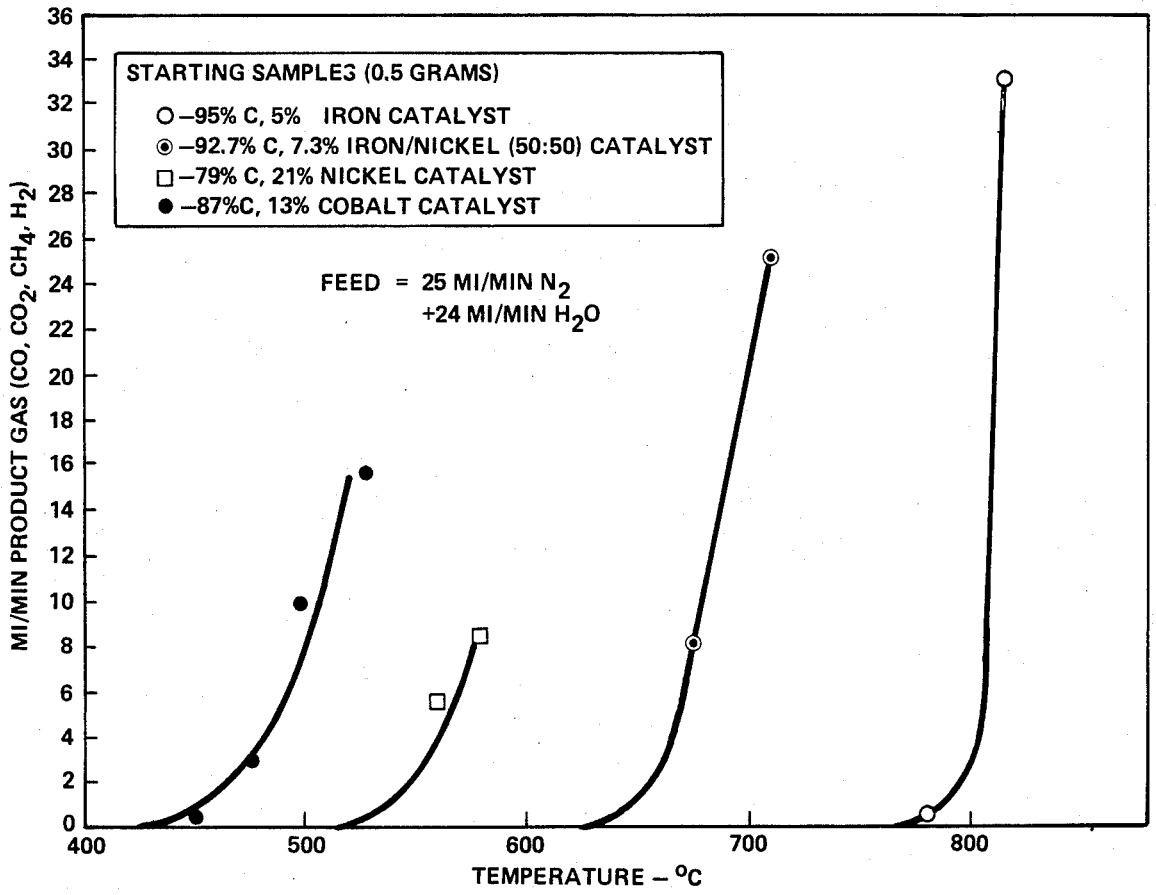

CARBONACEOUS MATERIAL AND METHODS FOR MAKING HYDROGEN AND LIGHT HYDROCARBONS FROM SUCH MATERIALS

CROSS-REFERENCES

This application is continuation of application Ser. No. 248,597 filed on Mar. 27, 1981, now abandoned; which is a continuation-in-part of application Ser. No. 99,789 filed Dec. 3, 1979, now abandoned; which is a continuation-in-part of application Ser. No. 917,240 filed June 20, 1978, now abandoned; which is a continuation-in-part of application Ser. No. 817,647 filed July 21, 1977, now abandoned.

This invention relates to new processes for making hydrogen, oxides of carbon, methane, other light hydrocarbons, and mixtures of two or more of these products by reacting carbonaceous materials comprising carbon, ferrous group metal components, and hydrogen with steam. These processes produce commercially attractive product yields in commercially attractive temperature ranges.

The invention also relates to new carbonaceous materials comprising carbon, hydrogen, and ferrous group metal components, particularly nickel and cobalt. To make these new carbonaceous materials, we react a gaseous mixture that includes carbon monoxide and hydrogen with one or more ferrous group metal components.

Copending U.S. patent application Ser. No. 99,789, filed Dec. 3, 1979 in the U.S. Patent and Trademark Office, discloses a broad class of carbonaceous materials that include the new carbonaceous materials of this invention. That application also discloses methods for making our new carbonaceous materials. By this reference, we incorporate in this application the entire disclosure of that application, and of the applications referred to therein, namely U.S. patent application Ser. No. 917,240 and U.S. patent application Ser. No. 817,647 filed in the U.S. Patent and Trademark Office on June 20, 1978 and July 21, 1977, respectively.

The new carbonaceous materials include a major amount of carbon, and minor amounts of hydrogen, and one or more ferrous group metal components. The new carbonaceous materials include from about 55 percent by weight to about 98 percent by weight of carbon, and preferably from about 75 percent by weight to about 95 percent by weight. The ferrous group metal components constitute an amount in the range of about one percent to about 44 percent, preferably in the range of about 25 percent to about 5 percent by weight, of the carbonaceous material. At these high carbon-to-metal ratios, the carbonaceous materials react readily with steam to produce large, commercially attractive quantities of hydrogen, methane, and/or other light hydrocarbons in commercially attractive temperature ranges. Moreover, our carbonaceous materials exhibit excellent fluidity in fluid bed reactors, where these carbonaceous materials are reacted with steam. These carbonaceous materials also include hydrogen in amounts ranging from about 0.1 to about 1.0 percent by weight. Measured by low temperature gas adsorption methods, the carbonaceous materials have total surface areas in the range of about 100 to about 300 square meters per gram of carbonaceous material, and pore volumes in the range of about 0.3 to about 0.6 milliliters (ml) per gram of carbonaceous material.

The ferrous group metal components in our new carbonaceous materials are selected from the group consisting of nickel, cobalt, nickel alloys, and cobalt alloys, and mixtures of these metals and alloys. Broadly, iron constitutes no more than about 30 percent by weight, and preferably no more than about 10 percent by weight, of the ferrous group metal component content of our new carbonaceous materials. Nickel and cobalt constitute at least 70 percent by weight of the ferrous group metal component content in our carbonaceous materials.

Our new carbonaceous materials, prepared by the deposition processes referred to hereafter, typically include several phases. The major phase includes about 95% to about 99.9% carbon by weight, and hydrogen in an amount of about 0.1 percent to about 1 percent. The balance, if any, is one or more of the ferrous group metal components set forth above. Dispersed throughout this major phase are ferrous group metal component-rich minor phases comprising at least about 50 percent by weight of such metals as explained and as limited above. The remainder of the minor phases is principally carbon, but may include some hydrogen.

Figure 5:
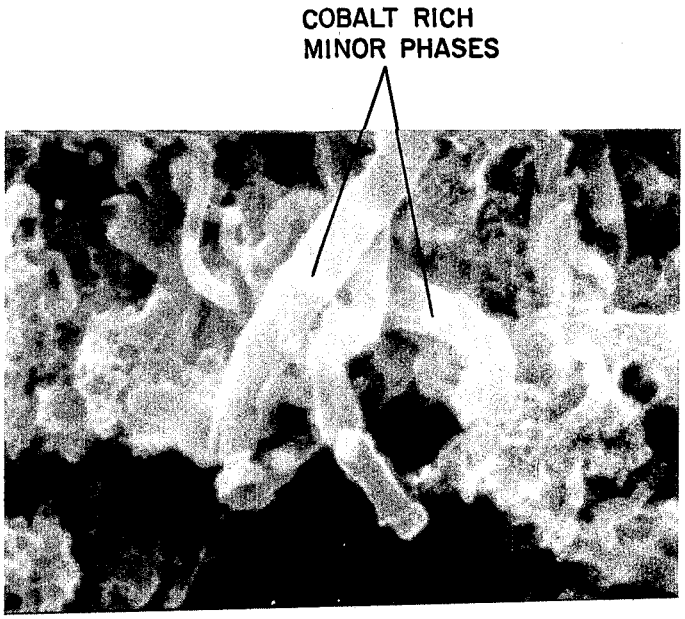

Made by our preferred deposition methods, our new carbonaceous materials appear fibrous under the high magnification of a transmission or scanning electron microscope. FIG. 5 is a scanning electron micrograph of a cobalt-containing carbonaceous fiber. This fibrous carbonaceous material contains more than about 90 percent by weight carbon, and includes at least about 5 percent by weight of cobalt-rich minor phases of the kind described above, as indicated at the arrow in FIG. 5.

Broadly, the methods for making our new carbonaceous materials comprise depositing carbon from carbon monoxide-containing gas mixtures over one or more ferrous group metal initiators. In the process of carbon deposition, ferrous metal is transferred from the initiator to our carbonaceous material and becomes an integral part of these materials as described above. The ferrous group metal starting materials, called initiators in the deposition reaction to distinguish them from ferrous group metal components in our new carbonaceous materials, can be supported or unsupported ferrous group metals, ores, alloys or mixtures of such species.

The deposition processes take place at pressures in the range of about 1 to about 100 atmospheres or more, and at temperatures in the range of about 300° C. to about 700° C. Where the ferrous group metal component includes more than about 70 percent by weight nickel, and the carbon deposition temperature is in the range of about 300° C. to about 500° C, the carbonaceous material is especially suitable for making methane by reaction with steam. At deposition temperatures above about 550° C., and especially where the ferrous group metal component is more than about 70 percent by weight cobalt, the carbonaceous material is especially suitable for making hydrogen by reaction with steam.

Our new carbonaceous materials are highly reactive with steam at pressures in the range from about 1 to about 100 atmospheres or more and at temperatures in the range of about 500° C. to about 750° C. From these steaming reactions, we obtain product gas mixtures that include hydrogen, carbon monoxide, carbon dioxide, methane and other light hydrocarbons. The quantities of each gas produced in the steaming reactions depend on the nature of the carbonaceous material and the temperature and pressure at which the steam gasification takes place. In particular, carbonaceous materials formed at temperatures in the range of about 300° C. to about 500° C., especially those formed in this temperature range from nickel alone or from ferrous group metal components containing at least about 70 percent by weight nickel, tend to produce substantial quantities of methane in the steam gasification reactions of this invention. By contrast, carbonaceous materials formed at temperatures above about 550° C., especially those carbonaceous materials formed above this temperature from cobalt alone or from ferrous group metal components containing at least about 70 percent by weight cobalt, tend to produce substantial quantities of hydrogen in the steam gasification reactions of this invention.

Where the molar ratio of steam fed to carbon gasified is at least about 3, (and therefore exceeds the amount required for thermodynamic equilibrium), and the steam gasification pressure is in the range of about 1 to about 10 atmospheres, the gasification reaction tends to produce hydrogen in large quantities, especially where the carbonaceous material is cobalt-based. Where the molar ratio of steam fed to carbon gasified is less than about 3, and the steam gasification pressure is in the range of about 10 to about 100 atmospheres, (and therefore nearly equals the amount required for thermodynamic equilibrium), the gasification reaction tends to produce methane in large quantities, especially where the carbonaceous material is nickel-based.

The gaseous products initially formed in the steaming reactions of this invention can be converted to gas mixtures richer in hydrocarbons, hydrogen, or both, by lowering the temperature of the gaseous products and contacting these products with either fresh or partially reacted carbonaceous material in the range of about 300° C. to about 500° C., and by adjusting the pressure and steam feed rate to produce the desired gases, as explained below.

Our new carbonaceous materials serve distinctly different purposes in the initial steam gasification process of this invention and in the subsequent, lower temperature conversion reaction of the gasification products from the steaming reactions. In the steaming reactions, our new carbonaceous materials participate as reactants. In the subsequent conversion of the steam gasification products to either hydrogen-rich or hydrocarbon-rich product gas mixtures at temperatures below the steam gasification temperatures our carbonaceous materials serve as a catalyst.

The carbon monoxide-containing gas mixtures used in the deposition processes for making our new carbonaceous materials can be low pressure or high pressure producer or synthesis gases. Such gas mixtures may include substantial quantities of nitrogen and carbon dioxide, but must contain little or no sulfur compounds such as hydrogen sulfide, carbon disulfide or sulfur dioxide. If necessary, carbon monoxide-containing gas mixtures are pretreated by known methods for removing sulfur-containing gases before carbon deposition begins.

Carbon deposition removes some of the carbon from the carbon monoxide-containing gas mixtures at nearly 100 percent thermal efficiency since the heat of reaction may remain as sensible heat in the carbon monoxide-depleted fuel gas stream. The reaction heated, carbon monoxide-depleted gas mixture from the carbon deposition reaction is a good fuel source for generating combined cycle electric power.

A surprising and unexpected aspect of our methods for steam gasification of the new carbonaceous materials is that where such carbonaceous materials contain iron as the chief ferrous metal component, such carbonaceous materials have quite low rates of reactivity with steam at temperatures in the range of about 500° C. to about 600° C. Steam gasification, of such carbonaceous materials at temperatures above about 700° C. is adversely affected by the side reaction of the iron component with steam, and gasification ceases long before all of the carbon is gasified. By contrast, our new carbonaceous materials, which contain substantial amounts of nickel, cobalt, nickel alloys, cobalt alloys and mixtures thereof, have high reaction rates with steam, and do not suffer from deactivating side reactions. FIG. 1 illustrates the range of steam reactivities with several different carbonaceous materials, including those of our invention.

To obtain the data illustrated in the graph of FIG. 1, we passed gas mixtures comprising 85 percent carbon monoxide and 15 percent hydrogen over small samples of iron, nickel and cobalt initiators until the carbon-to-metal ratio of each sample reached four or more. We then steam gasified 0.5-gram samples of each carbonaceous material at progressively increasing temperatures, and measured the rate of production of the dry gasification products formed. As FIG. 1 shows, the reactivities of these carbonaceous materials with steam varied greatly. The cobalt-containing carbonaceous material gasified rapidly at 500° C. By contrast, the iron-based carbonaceous material was inactive until the temperature reached 800° C. Accordingly, the nickel and cobalt-based carbonaceous materials are far more attractive for commercial manufacture of hydrogen and methane, particularly because the steam-carbonaceous material reactions are endothermic, and must be driven by indirect heat transfer. At temperatures in the range of about 500° C. to about 600° C., where our nickel-based and cobalt-based carbonaceous materials readily steam gasify, indirect heat transfer is easily effected by state of the art technique. At 800° C. and higher, indirect heat transfer is difficult to achieve and costly as well.

Figure 2:
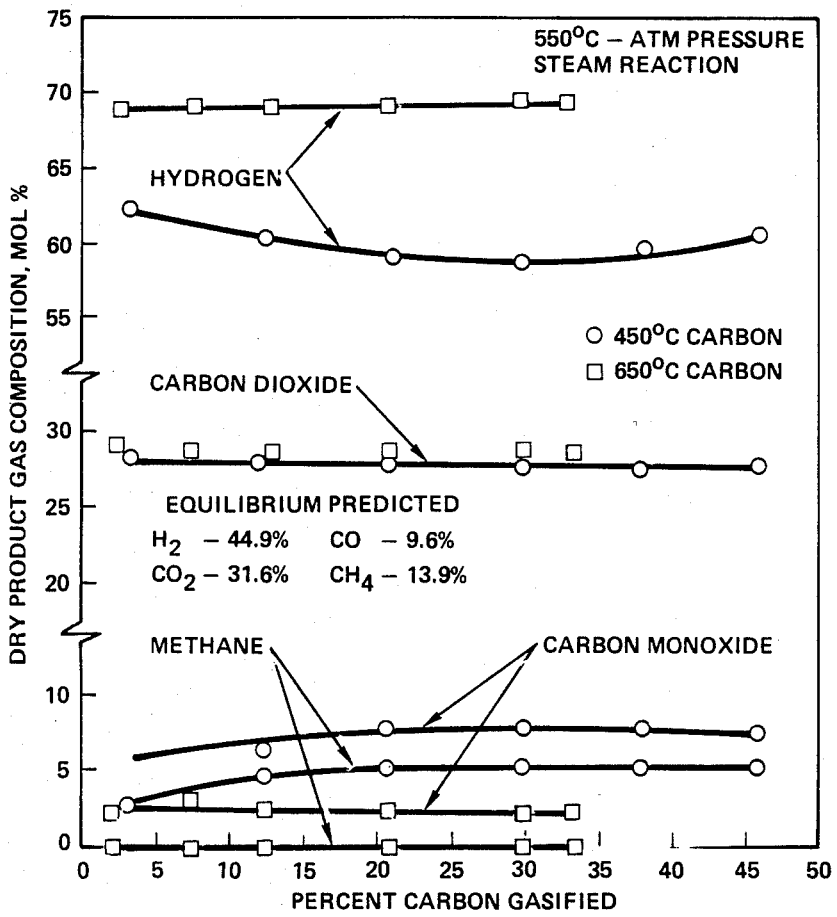

FIG. 2 illustrates the effect that the temperature of carbon deposition exerts on the composition of product gases made by steam gasification of the new carbonaceous materials of our invention. To show this effect, we prepared two different cobalt-based carbonaceous materials by depositing carbon from a mixture comprising 85 percent carbon monoxide and 15 percent hydrogen at atmospheric pressure. We prepared both carbonaceous materials by reaction with cobalt powder, forming one sample at 450° C. and the other at 650° C. We continued the deposition reaction until we obtained a carbon-to-cobalt weight ratio of ten. We then reacted each sample with steam at 550° C. and atmospheric pressure. As FIG. 2 shows, the carbonaceous material deposited at 650° C. produced far more hydrogen in the steam gasification reaction then did the cobalt-based carbonaceous material produced at 450° C. Indeed, after removing the carbon dioxide formed during steam gasification, the carbonaceous material formed at 650° C. produces nearly pure hydrogen upon steaming at 550° C.

The data in Tables 1 and 2 show differences in final product gas composition where the products of steam-carbon gasification of carbonaceous reactants containing different ferrous group metals further react at temperatures below the carbon gasification point of about 500° C. In Table 1, a carbonaceous material comprising about 90 percent carbon and about 9 percent nickel, prepared by carbon deposition on nickel powder, at about 450° C., catalyzed the further conversion of a typical steam-carbon gasification mixture of carbon monoxide, hydrogen and steam at 400° C. and about 1 atmosphere pressure in a steady flow reactor. As Table 1 shows, nearly all of the carbon monoxide was converted to methane and carbon dioxide, with very little additional gasification of solid carbon (0.04 gram out of 0.83 gram in 203 minutes).

Figure 3:
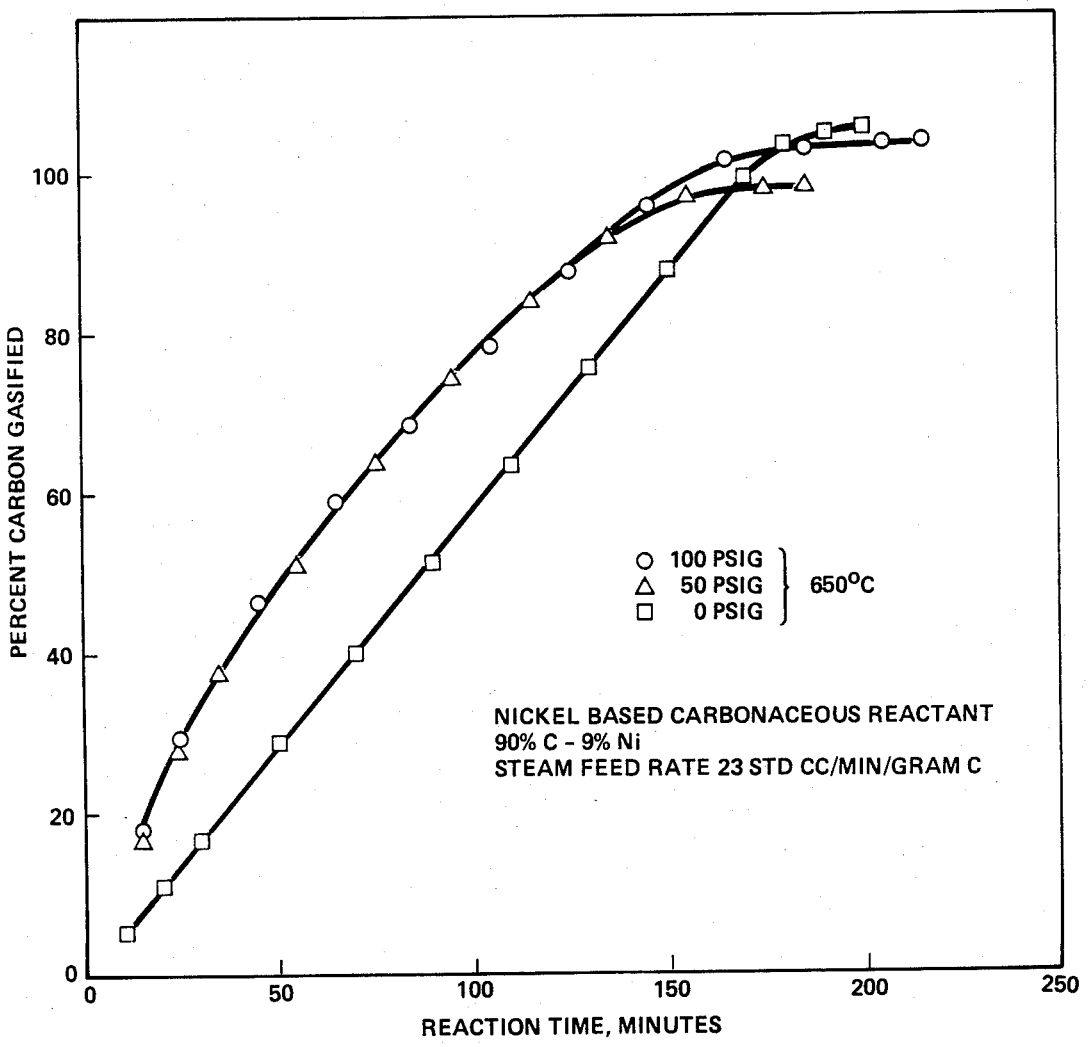

Table 2 relates to an identical run, with one exception: The carbonaceous material contained cobalt instead of nickel (about 90 percent carbon, and about 9 percent cobalt). These data show that cobalt-based carbonaceous material is less effective in converting the gas mixture to methane than the nickel-based material (27.2 percent methane for nickel-based; 9.5 percent, for cobalt-based), but more effective in shifting to hydrogen (49.8 percent hydrogen from cobalt-based material; 27.0 percent for nickel-based material).

initially in the reactor. FIG. 3 shows that the carbon gasification rate was nearly linear until substantially all the carbon was gasified. Moreover, this rate did not vary appreciably with pressure. By contrast, the product composition set forth in Table 3 did change substantially depending on the pressure. As the pressure rose from one atmosphere to 7.8 atmospheres, the methane concentration tripled, the carbon monoxide concentration decreased by a factor of two, the hydrogen concentration decreased from about 53 percent to about 43 percent, and the carbon dioxide concentration rose from about 21 percent to about 31 percent.

Figure 4:
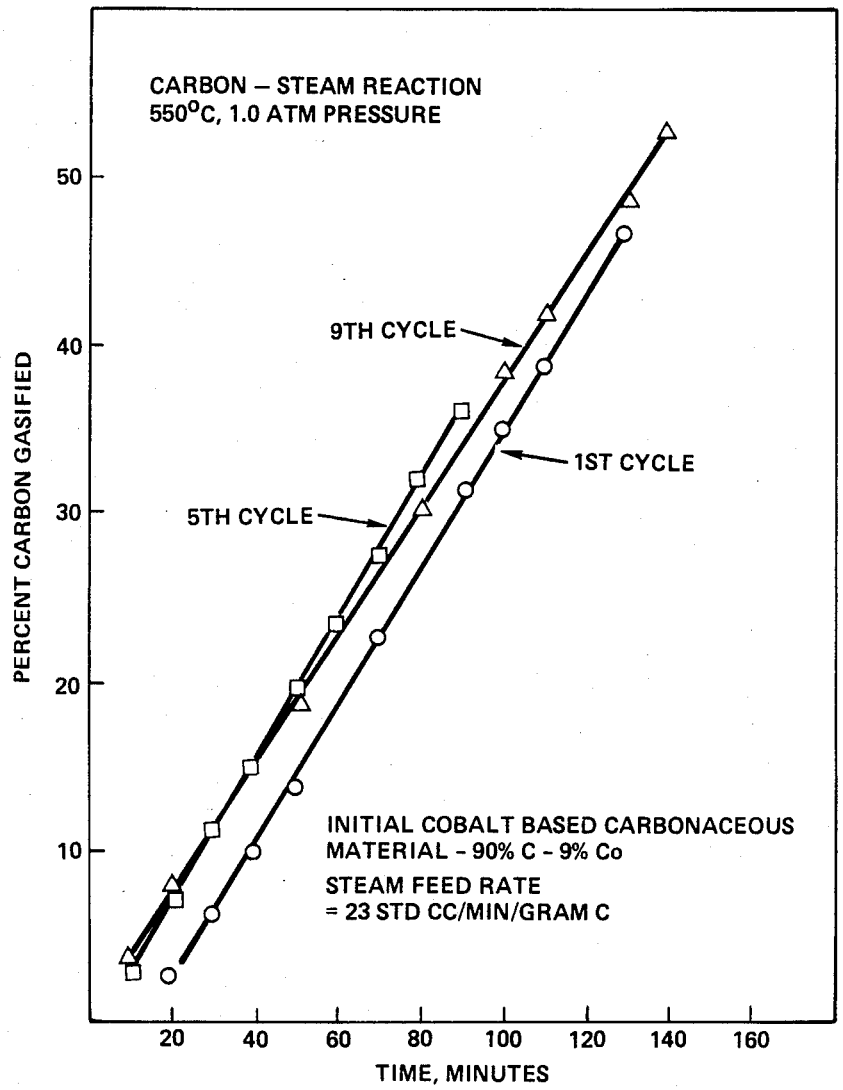

FIG. 4 shows that our new carbonaceous materials can cycle many times between the carbon-rich states entering the steam gasification process of our invention, and the carbon-lean states resulting from the steam gasification processes of our invention. To illustrate this point, we prepared a one gram sample of a carbonaceous material comprising about 90 percent carbon and about 9 percent cobalt by depositing carbon from a gas mixture comprising about 85 percent carbon monoxide and about 15 percent hydrogen at 45° C. and one atmosphere pressure. We steam gasified this carbonaceous material at 550° C. and one atmosphere pressure until we had gasified about 45 percent of its carbon content. We then returned the residue to the deposition reaction, and resumed deposition until the carbon content had attained the pre-gasification levels. We repeated this cycle of carbon deposition and steam gasification nine times, and obtained the data set forth in FIG. 4. FIG. 4

TABLE 1

FURTHER CONVERSION OF STEAM-CARBON GASIFICATION PRODUCTS OVER A NICKEL-CARBON (90% CARBON) CARBONACEOUS MATERIAL AT 400° C.

| | | INPUT | | | | OUTPUT | | | | | |
|---|---|---|---|---|---|---|---|---|---|---|---|
| SAMPLE NO. | TIME (MIN) | $V_{H_2/CO}$ (l) | $H_2$ MOLE % | CO MOLE % | $V_{H_2O}$ CC LIQUID | VOLUME (l) | $H_2$ | $CO_2$ | CO | $CH_4$ | $N_2$ |
| 1 | 7.7 | .33 | 48.0 | 51.5 | .16 | .25 | 29.0 | 34.5 | 0.9 | 24.6 | 1.1 |
| 2 | 26.6 | 1.1 | 48.0 | 51.5 | .56 | .91 | 29.0 | 34.5 | 1.0 | 24.7 | 0.8 |
| 3 | 43.9 | 1.9 | 48.0 | 51.5 | .92 | 1.5 | 27.5 | 33.6 | 1.3 | 26.3 | 0.7 |
| 4 | 63.4 | 2.7 | 48.0 | 51.5 | 1.3 | 2.2 | 31.1 | 34.5 | 0.8 | 23.2 | 0.9 |
| 5 | 81.0 | 3.4 | 48.0 | 51.5 | 1.7 | 2.8 | 25.3 | 34.2 | 0.9 | 29.4 | 0.9 |
| 6 | 123 | 5.2 | 48.0 | 51.5 | 2.6 | 4.2 | 24.3 | 35.1 | 0.9 | 29.4 | 0.9 |
| 7 | 193 | 8.2 | 48.0 | 51.5 | 4.1 | 6.7 | 25.2 | 35.4 | 0.9 | 28.0 | 0.9 |
| 8 | 203 | 8.6 | 48.0 | 51.5 | 4.3 | 7.0 | 24.3 | 35.4 | 1.0 | 29.3 | 0.6 |
| | | | AVERAGE | | | | 27.0 | 34.7 | 1.0 | 27.2 | .85 |

$H_2$/CO FLOW 42.5 CC/MIN @ 25° C.
$H_2O$ FLOW 0.021 CC (LIQUID)/MIN @ 25° C.
SAMPLE WEIGHT .92 g
NET CARBON LOSS .04 g

TABLE 2

FURTHER CONVERSION OF STEAM-CARBON GASIFICATION PRODUCTS OVER A COBALT-CARBON (90% CARBON) CARBONACEOUS MATERIAL AT 400° C.

| | | INPUT | | | | | OUTPUT | | | | |
|---|---|---|---|---|---|---|---|---|---|---|---|
| SAMPLE NO. | TIME (MIN) | $V_{H_2/CO}$ (l) | $H_2$ MOLE % | CO MOLE % | $V_{H_2O}$ CC LIQUID | $V_T$ (l) | $H_2$ | $CO_2$ | CO | $CH_4$ | $N_2$ |
| 1 | 10.5 | .44 | 48.5 | 50.5 | .22 | .45 | 50.6 | 29.8 | 3.3 | 12.0 | 1.2 |
| 2 | 25.7 | 1.1 | 48.5 | 50.5 | .53 | 1.2 | 49.5 | 28.5 | 4.2 | 10.4 | 1.4 |
| 3 | 40.8 | 1.7 | 48.5 | 50.5 | .85 | 1.7 | 49.3 | 27.9 | 4.7 | 9.3 | 2.4 |
| 4 | 55.2 | 2.3 | 48.5 | 50.5 | 1.2 | 2.5 | 45.7 | 28.0 | 5.0 | 8.8 | 2.3 |
| 5 | 72.1 | 3.1 | 48.5 | 50.5 | 1.5 | 3.3 | 52.9 | 28.0 | 5.1 | 8.6 | 1.0 |
| 6 | 89.4 | 3.8 | 48.5 | 50.5 | 1.9 | 4.1 | 54.8 | 28.0 | 5.0 | 8.9 | 0.9 |
| 7 | 100.6 | 4.3 | 48.5 | 50.5 | 2.1 | 4.6 | 46.4 | 28.0 | 5.1 | 8.9 | 1.4 |
| 8 | 110.4 | 4.7 | 48.5 | 50.5 | 2.3 | 5.1 | 52.3 | 28.0 | 5.1 | 9.0 | 1.2 |
| | | | AVERAGE | | | | 49.8 | 28.1 | 4.6 | 9.5 | 1.5 |

$H_2$/CO FLOW 42.5 CC/MIN @ 25° C.
$H_2O$ FEED 0.021 CC LIQUID/MIN @ 25° C.
SAMPLE WEIGHT 1.08 g
NET CARBON GAIN 0.02 g

Pressure has no significant effect on the rate at which steam gasification of our carbonaceous materials proceeds, but does affect the composition of the product gases obtained. FIG. 3 and Table 3 set forth data obtained from steaming a nickel-based carbonaceous material at 650° C. at three different pressures, namely one atmosphere, 4.4 atmospheres, and 7.8 atmospheres. We conducted all these runs in small, fluidized bed, steady flow reactors at a constant steam feed rate of 23 standard cubic centimeters per minute per gram of carbon shows that the rate of steam gasification did not vary significantly from one cycle to the other.

TABLE 3

| PRODUCT COMPOSITION DEPENDENCE ON PRESSURE | | | | |
|---|---|---|---|---|
| | | DRY PRODUCT GAS COMPOSITION, MOLE PERCENT | | |
| COMPONENT | PERCENT CARBON GASIFIED | 1 ATM | 4.4 ATM (50 PSIG) | 7.8 ATM (100 PSIG) |
| HYDROGEN | 10 | 52.2 | 44.5 | 41.8 |
| | 50 | 52.9 | 48.7 | 43.5 |
| | 90 | 53.6 | 51.1 | 45.9 |
| METHANE | 10 | 3.8 | 12.6 | 15.9 |
| | 50 | 4.9 | 10.2 | 14.5 |
| | 90 | 3.8 | 8.3 | 12.5 |
| CARBON MONOXIDE | 10 | 23.9 | 14.1 | 11.2 |
| | 50 | 21.1 | 11.4 | 9.6 |
| | 90 | 20.8 | 9.7 | 10.3 |
| CARBON DIOXIDE | 10 | 20.1 | 28.8 | 31.1 |
| | 50 | 21.1 | 29.7 | 32.4 |
| | 90 | 21.8 | 30.9 | 31.3 |

NICKEL BASED CARBONACEOUS REACTANT - 90% C—9% Ni
STEAMED AT 650° C. FOR ALL RUNS
STEAM FEED RATE - 23 STD CC/MIN/INITIAL GRAM CARBON IN REACTOR

The following examples show that the cobalt-based carbonaceous materials of our invention react readily with steam at low temperatures to produce commercially attractive quantities of gas mixtures comprising hydrogen, carbon oxides, and methane, at a rate of at least about 0.2 moles of carbon gasified per mole of carbon present per hour when steam is fed to the reaction at the rate of about 1.0 mole per hour per mole of carbon present at a temperature of about 550° C. and at a pressure of about 1 atmosphere.

Into a horizontal tube reactor we placed 0.5 gram of reduced cobalt oxide powder, and fed to the reactor a steam of 200 standard cubic centimeters per minute of a gas mixture comprising 85 percent carbon monoxide and 15 percent hydrogen at 450° C. and 1 atmosphere pressure. We continued this procedure until 3.3 grams of carbonaceous material formed.

We removed the carbonaceous material formed, and determined that the carbonaceous material comprised about 87 percent carbon, about 12 percent cobalt, and about 1 percent hydrogen. We divided these materials into three one gram samples, and placed each sample in turn in a small, vertical, fixed bed reactor with the sample suspended between quartz wool plugs. We placed the reactor in a tube furnace which controlled the reactor temperature throughout the steam gasification process. We fed steam to the reactor at atmospheric pressure and at a rate of 20.8 standard cubic centimeters per minute, holding the temperature at 525° C. during the first run. We measured the volume of dry product gasses formed with a wet test meter, and determined the composition of the mixture by gas chromatography. We condensed and periodically weighed the unreacted steam. We continued each run until no further gas formed. We repeated these runs two additional times, once at 550° C., and once at 600° C. Tables 4, 5, and 6 present the outlet gas composition, the volume of product gas, the cumulative percent carbon gasified as a function of time and the average carbon balances obtained in these runs.

Figure 6:
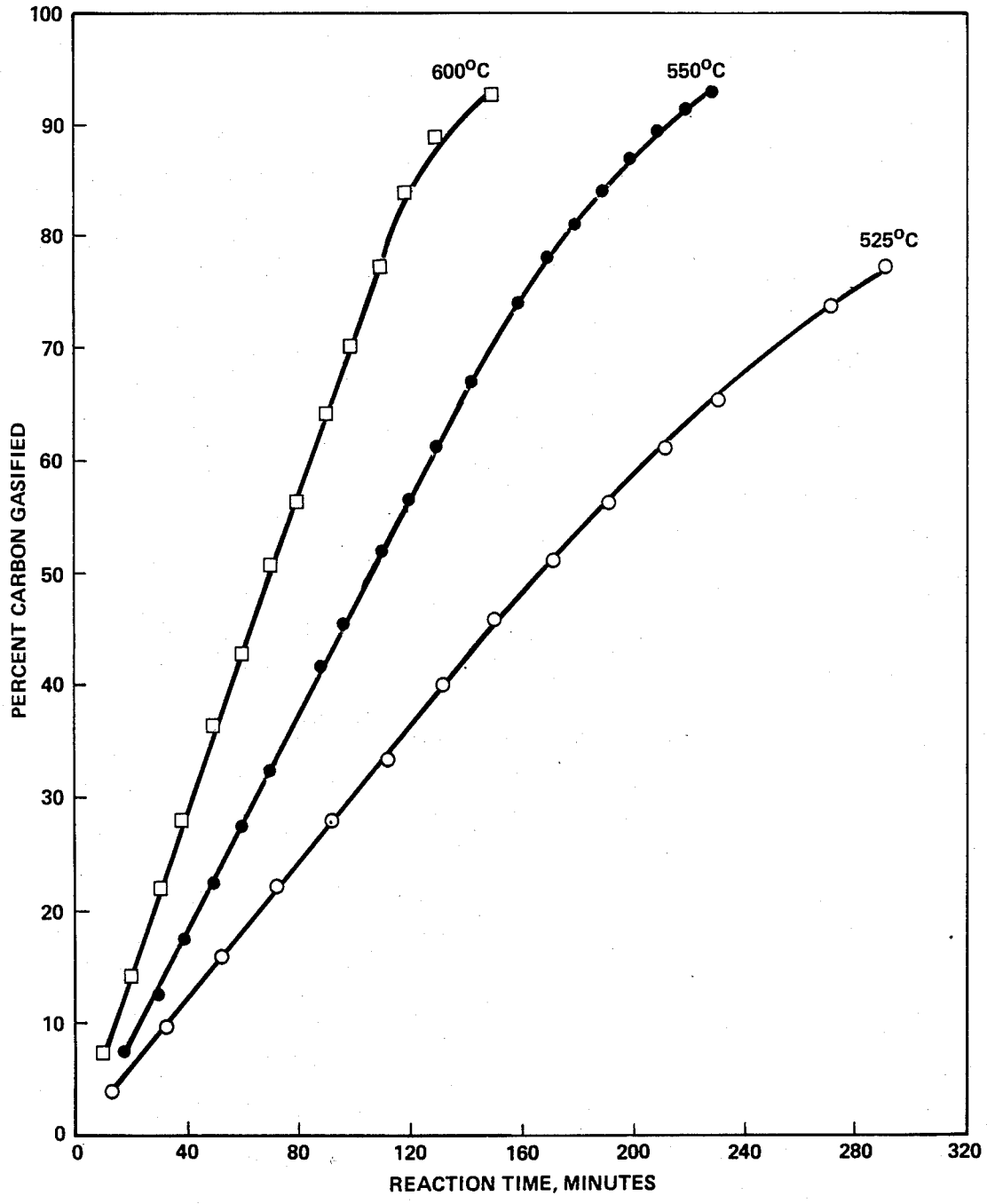
Figure 7:
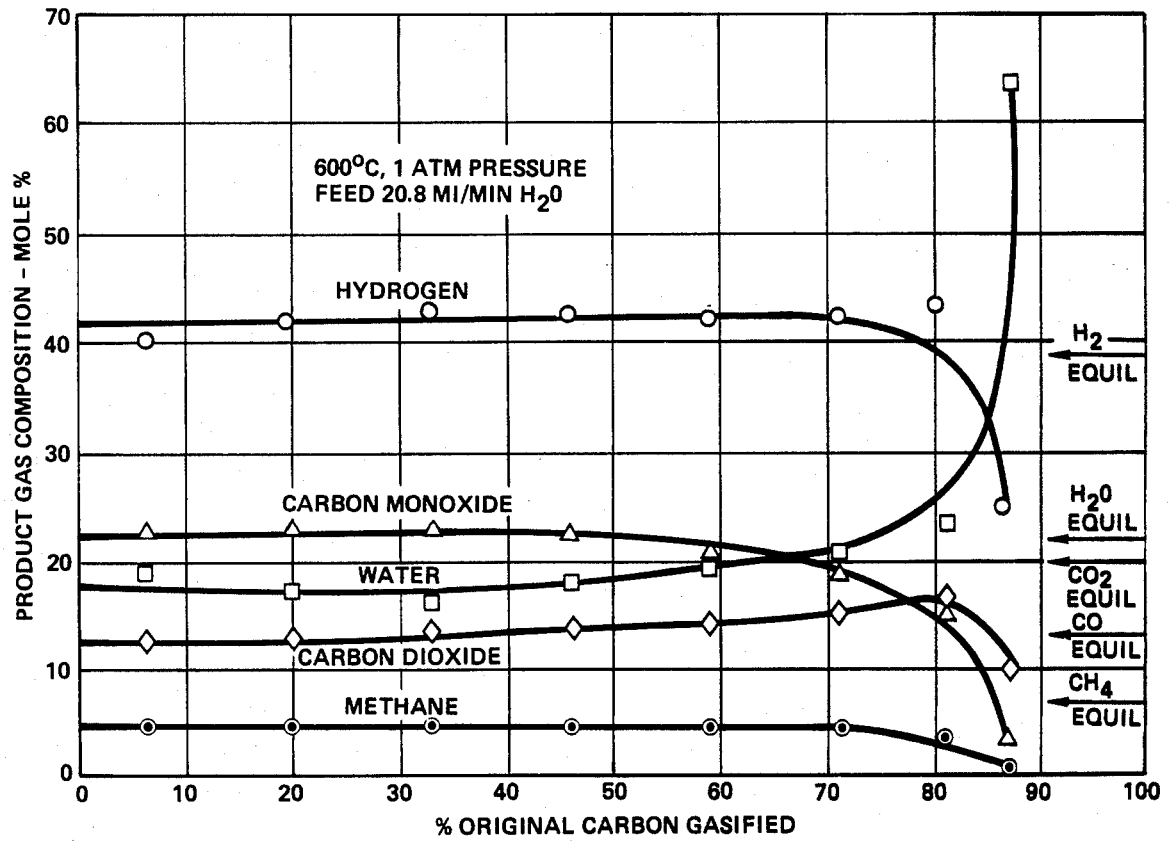

FIG. 6 plots the percent carbon gasified as a function of time at each temperature. The carbon gasification rates, shown by the slopes of the lines in FIG. 6, were nearly constant until nearly all the carbon in the samples gasified. The gasification rates increased slightly with temperature, primarily because of equilibrium considerations. As reaction temperature increased, the amount of carbon gasified per mole of steam fed to the reactor rose at equilibrium. As Table 7 and FIG. 7 show, these runs operated at near-equilibrium conditions. The run represented by Table 7 occurred at 550° C. and the run represented by FIG. 7 occurred at 600° C.

TABLE 4

| TYPICAL DATA SET AND CARBON MASS BALANCE FOR PACKED-BED CARBON-STEAM REACTION (87% C—13% Co, 525° C.) | | | | | | | | |
|---|---|---|---|---|---|---|---|---|
| REACTION TIME, MIN. | DRY PRODUCT GAS VOLUME, CC (STP) | PRODUCT COMPOSITION, MOL % $H_2$ | CO | $CH_4$ | $CO_2$ | $H_2O$ | GRAMS CARBON GASIFIED CUMULATIVE | PERCENT CARBON GASIFIED |
| 10 | 142 | 32.4 | 3.8 | 2.3 | 16.7 | 44.4 | 0.029 | 3.2 |
| 20 | 312 | 37.8 | 3.8 | 2.6 | 19.2 | 36.0 | 0.062 | 7.0 |
| 40 | 595 | 32.7 | 3.3 | 2.3 | 16.4 | 44.8 | 0.117 | 13.4 |
| 60 | 907 | 38.2 | 3.8 | 2.6 | 19.2 | 36.0 | 0.179 | 20.3 |
| 90 | 1332 | 33.3 | 3.3 | 3.1 | 16.7 | 44.6 | 0.262 | 29.8 |
| 120 | 1785 | 38.7 | 3.8 | 2.2 | 19.2 | 36.1 | 0.360 | 39.7 |
| 150 | 2210 | 33.8 | 3.0 | 1.6 | 16.8 | 44.7 | 0.431 | 48.9 |
| 180 | 2606 | 28.4 | 2.2 | 1.2 | 14.0 | 54.0 | 0.500 | 56.8 |
| 210* | 3003 | 34.7 | 2.4 | 1.1 | 16.9 | 44.8 | 0.572 | 65.3 |

AVERAGE MASS BALANCE OVER REACTION $$\text{CARBON BALANCE} = \frac{\text{UNGASIFIED CARBON + CARBON PRODUCT GASES}}{\text{CARBON CHARGED}} = \frac{0.0852 + .796}{(1.0007)\,(.88)} \times 100 = 100.0$$

OXYGEN OUT = 0.0575 MOLES
HYDROGEN OUT = 0.117 MOLES $H_2/O_2$ = 2.03
*REACTION CONTINUED TO EXTINCTION (330 MIN TOTAL REACTION TIME)

TABLE 5

TYPICAL DATA SET AND CARBON MASS BALANCE FOR PACKED-BED CARBON-STEAM REACTION (87% C—13% Co, 550° C.)

| REACTION TIME, MIN. | DRY PRODUCT GAS VOLUME, CC (STP) | PRODUCT COMPOSITION, MOL % $H_2$ | CO | $CH_4$ | $CO_2$ | $H_2O$ | GRAMS CARBON GASIFIED CUMULATIVE | PERCENT CARBON GASIFIED |
|---|---|---|---|---|---|---|---|---|
| 10 | 113 | 17.4 | 4.3 | 1.7 | 10.5 | 55.8 | 0.020 | 2.3 |
| 30 | 510 | 37.6 | 8.1 | 6.6 | 20.2 | 27.5 | 0.114 | 12.9 |
| 50 | 907 | 37.8 | 7.9 | 6.5 | 19.7 | 28.1 | 0.206 | 23.3 |
| 70 | 1332 | 37.8 | 7.7 | 6.4 | 19.6 | 28.3 | 0.305 | 34.4 |
| 90 | 1728 | 38.6 | 7.7 | 5.8 | 19.8 | 28.0 | 0.395 | 44.6 |
| 110 | 2125 | 39.2 | 7.6 | 5.2 | 20.2 | 27.8 | 0.485 | 54.7 |
| 130 | 2465 | 40.0 | 7.2 | 5.0 | 20.2 | 28.0 | 0.560 | 63.2 |
| 150 | 2833 | 36.4 | 6.0 | 3.5 | 18.0 | 36.1 | 0.639 | 72.1 |
| 170* | 3173 | 38.7 | 4.4 | 1.9 | 18.4 | 36.5 | 0.706 | 79.7 |

AVERAGE MASS BALANCE OVER REACTION $$\text{CARBON BALANCE} = \frac{\text{UNGASIFIED CARBON + CARBON IN PRODUCED GAS}}{\text{CARBON CHARGED}} = \frac{0.0719 + 0.805}{.8856} \times 100 = 99$$

OXYGEN OUT = 0.050 MOLES $O_2$

HYDROGEN OUT = 0.104 MOLES $H_2$ $H_2/O_2 = 2.08$

*REACTION CONTINUED TO EXTINCTION (230 MIN TOTAL REACTION TIME)

TABLE 6

TYPICAL DATA SET AND CARBON MASS BALANCE FOR PACKED-BED CARBON-STEAM REACTION (87% C—13% Co, 600° C.)

| REACTION TIME, MIN. | DRY PRODUCT GAS VOLUME, CC (STP) | PRODUCT COMPOSITION, MOL % $H_2$ | CO | $CH_4$ | $CO_2$ | $H_2O$ | GRAMS CARBON GASIFIED CUMULATIVE | PERCENT CARBON GASIFIED |
|---|---|---|---|---|---|---|---|---|
| 10 | 286 | 43.1 | 24.4 | 5.0 | 13.7 | 13.8 | 0.066 | 7.1 |
| 30 | 575 | 45.2 | 24.9 | 5.1 | 14.2 | 10.6 | 0.203 | 22.0 |
| 50 | 863 | 45.3 | 24.4 | 5.0 | 14.3 | 11.0 | 0.338 | 36.6 |
| 70 | 1,148 | 44.5 | 23.6 | 4.9 | 14.3 | 12.7 | 0.469 | 50.8 |
| 90 | 1,428 | 44.3 | 21.6 | 4.7 | 15.0 | 14.4 | 0.593 | 64.2 |
| 110 | 1,705 | 44.1 | 20.4 | 4.7 | 15.5 | 15.3 | 0.713 | 77.2 |
| 130 | 1,977 | 44.9 | 15.9 | 3.6 | 17.4 | 18.2 | 0.821 | 88.9 |
| 150* | 2,199 | 25.2 | 3.5 | 0.3 | 10.7 | 60.3 | 0.855 | 92.5 |

AVERAGE MASS BALANCE OVER REACTION $$\text{CARBON BALANCE} = \frac{\text{(UNGASIFIED CARBON + CARBON IN PRODUCT GASES)}}{\text{CARBON CHARGED}} \times 100$$

$$= \frac{0.017 + 0.878\ G}{0.924} \times 100 = 96.9\%$$

*REACTION VOLUNTARILY TERMINATED.

TABLE 7

COMPARISON OF MEASURED STEAM-CARBON REACTION PRODUCTS WITH EQUILIBRIUM CALCULATIONS AT 550° C. (87% C—13% Co)

| | EQUILIBRIUM COMPOSITION AT 550° C.* (DRY BASIS) | MEASURED AT 550° C. (DRY BASIS) |
|---|---|---|
| $H_2$ | 42.9% | 52.2% |
| $CO_2$ | 30.8% | 27.5% |
| $CH_4$ | 14.9% | 9.2% |
| CO | 11.3% | 11.1% |

*1 ATM PRESSURE

Figure 8:
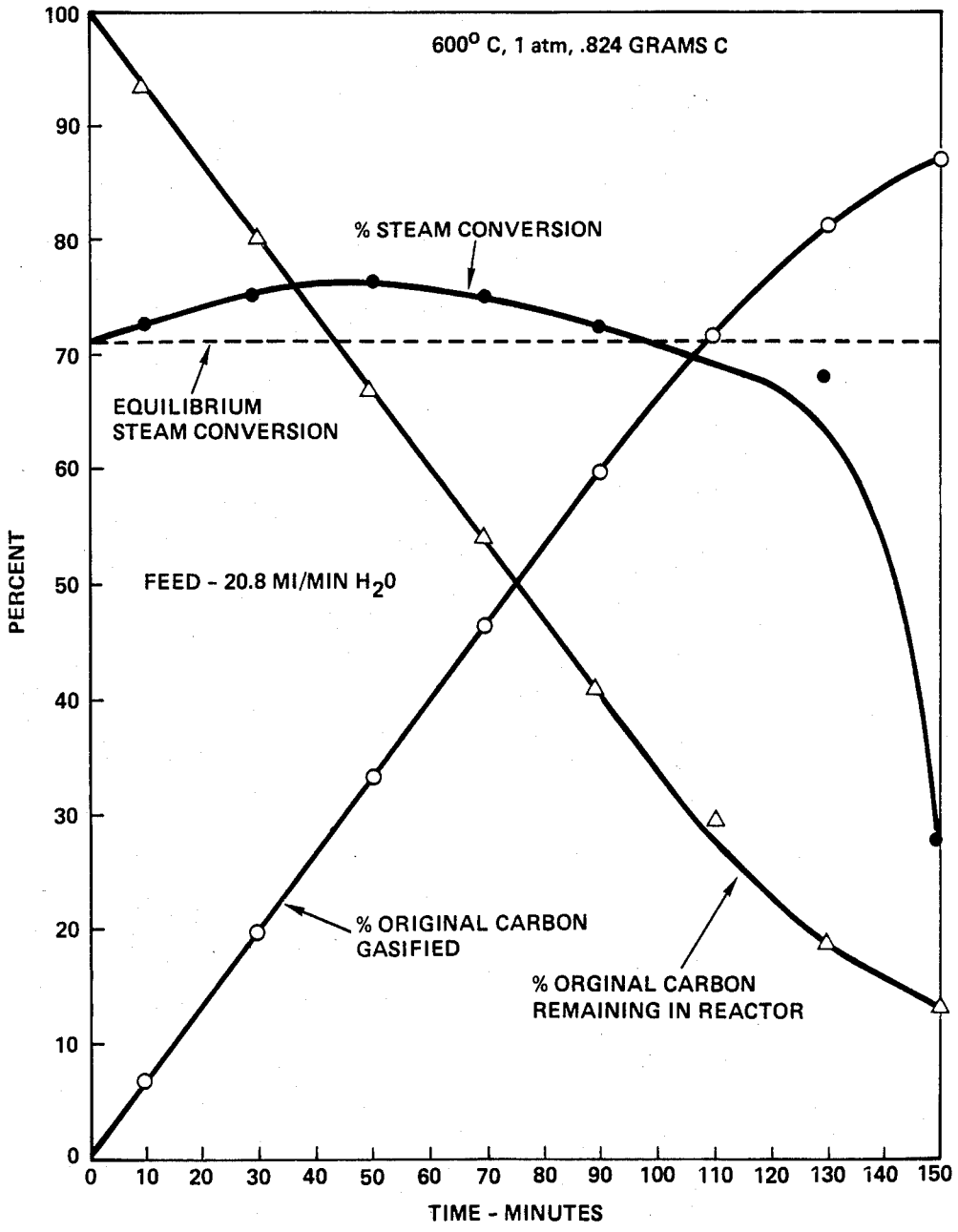

From the slopes of the lines shown in FIG. 6, we derived the overall carbon gasification rates at the conditions of temperature, pressure and steam feed rate used. For example, at 550° C., 28 percent of the original carbon gasified in one hour, meaning that the carbon gasification rate was 0.28 moles of carbon gasified per hour per mole of carbon initially in the reactor. The steam feed rate in this run was 0.752 moles of steam per hour per mole of carbon initially placed in the reactor. Because our processes operate close to equilibrium conditions, the overall carbon gasification rate is primarily a function of the steam feed rate, as FIG. 8 shows. There, the steam utilization at 600° C. is near equilibrium throughout the run.

Figure 9:
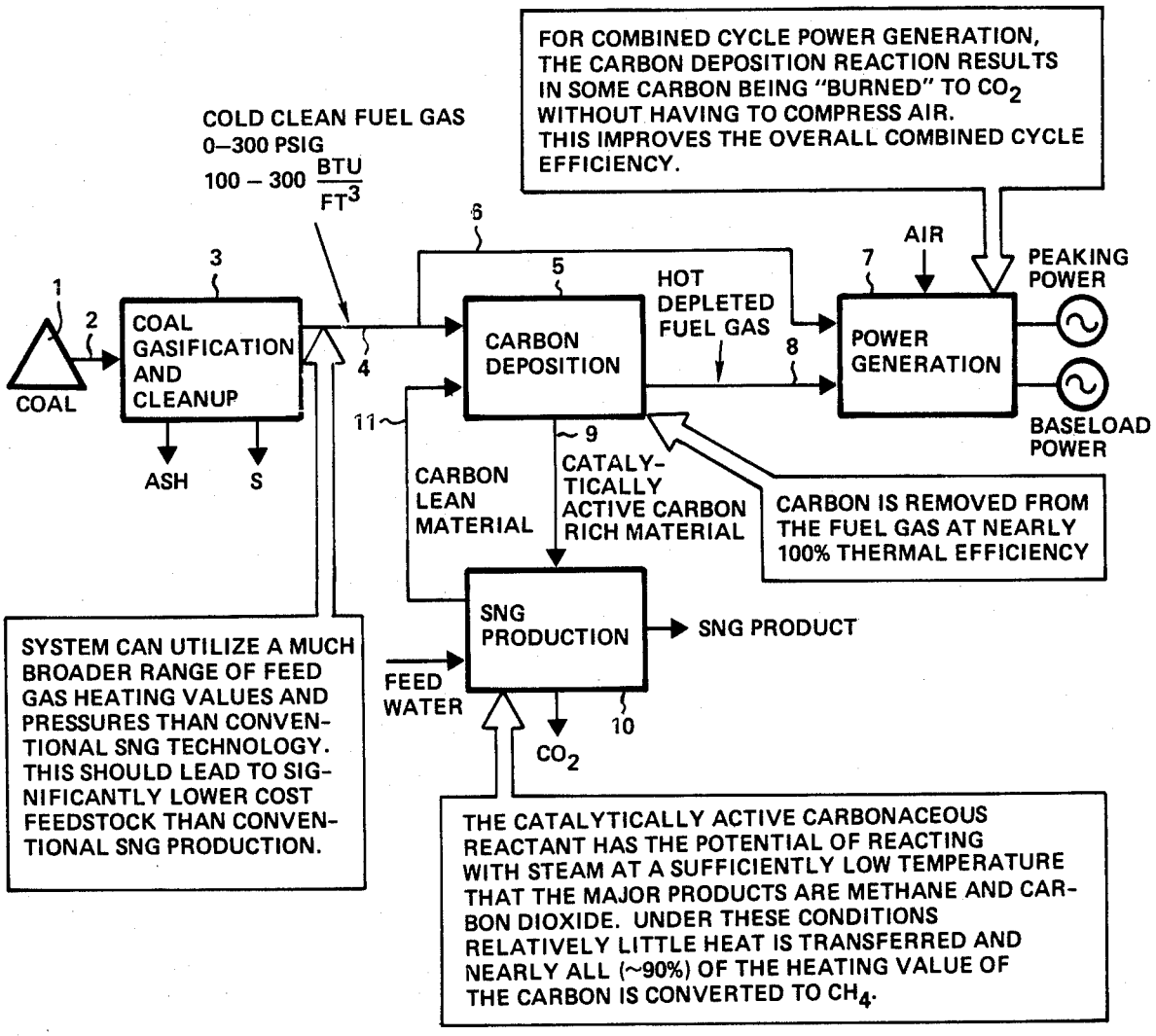

FIG. 9 is a block diagram showing some of the advantages of a preferred embodiment of our new processes for producing methane, or other synthetic natural gas, and electric power, from coal. In FIG. 9, coal from source 1 passes on path 2 to coal gasification and clean-up zone 3. There, the coal is converted to a gaseous mixture of nitrogen, carbon monoxide, carbon dioxide and hydrogen, and the ash, sulfur and water content of the mixture is reduced to acceptable levels by known methods. One advantage of our processes is that we can make synthetic natural gas by reacting coal with air instead of oxygen. Unlike other synthetic gas manufacturing processes, our processes are compatible with feed stocks containing substantial amounts of nitrogen and carbon dioxide. The cold, clean product gas then passes along path 4 to carbon deposition zone 5 where formation of our carbonaceous materials by deposition over one or more ferrous group metal initiators takes place. Some of the fuel gas may pass along path 6 directly to power generation zone 7, if desired, for combustion with air to generate base load and/or peaking power. Depleted fuel gas passes on path 8 to zone 7 for conversion to power in the same way.

Catalytically-active carbon rich carbonaceous material passes on path 9 to steam gasification zone 10 for reaction with steam to produce carbon monoxide, carbon dioxide, hydrogen, methane or possibly other light hydrocarbons, as desired. Carbon lean carbonaceous material is returned on path 11 to carbon deposition zone 5. Nearly all of the heating value of the carbonaceous material can be converted to methane or hydrogen in our steam gasification processes.

Following the process steps outlined in FIG. 9, we can withdraw, say, from about 25 percent to about 50 percent of the initial heating value from a carbon monoxide/hydrogen-containing fuel gas in the form of carbon, then use the depleted fuel gas as an energy source to generate electric power or to produce power quality steam. The withdrawn carbon, which is embodied in our new carbonaceous materials, can be steam gasified to convert from about 40 percent to about 80 percent of the carbon to hydrogen, carbon oxides, methane, and other light hydrocarbons. The carbon-depleted carbonaceous materials can be enriched in carbon by further carbon deposition from carbon monoxide/hydrogen gas mixtures such as the fuel gas referred to above, using the carbon-lean carbonaceous material from the steam gasification.

Figure 10:
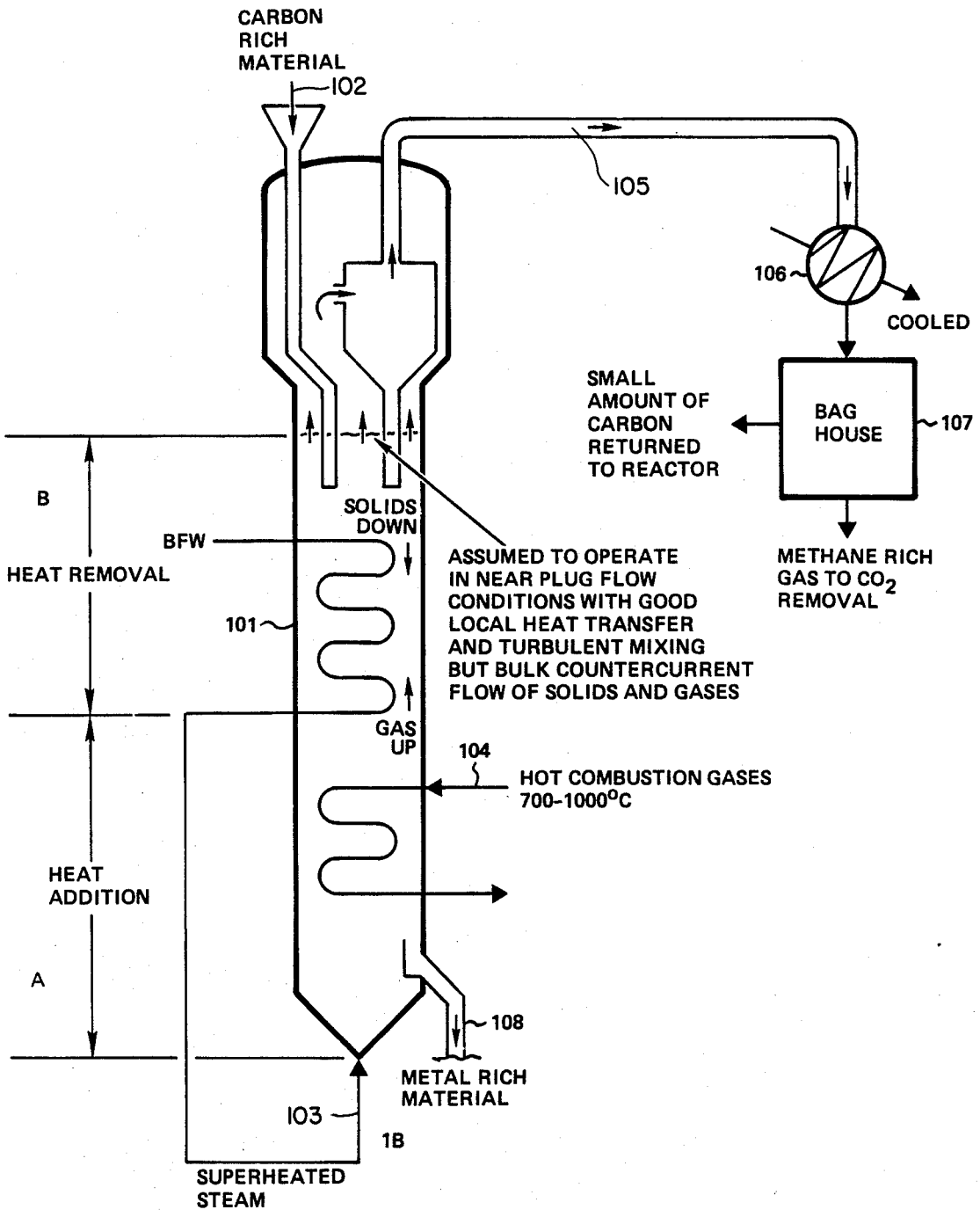

FIG. 10 shows one embodiment of a reactor for gasifying our carbonaceous materials under fluid bed conditions with steam. Our carbonaceous materials enter reactor 101, which has a high length-to-diameter ratio, on path 102, and pass downwardly under fluidizing conditions on path 102 toward the bottom of reactor 101. Superheated steam enters reactor 101 along path 103 and passes upwardly into contact with the descending carbonaceous materials. Hot combustion gasses enter reactor 101 in pipes 104, separate from the carbonaceous material, and pass through path 103 to provide the head required for reaction of steam with the carbonaceous materials. Carbon monoxide, hydrogen, methane and other gasses formed in hot reactor zone A pass upwardly through cooler zone B, where shift methanation reactions take place, but no further carbon gasifies. Product gasses exit reactor 101 on path 105, are cooled in cooling means 106, and then passed through bag house 107, where unreacted carbon is captured for return to reactor 101. Methane-rich gas passes from bag house 107 on path 108 for removal of carbon dioxide and other conventional polishing steps. Ferrous group metal component-rich material exits reactor 101 at the bottom, on path 108, and may be returned, if desired, to a carbon deposition reactor.

Figure 11:
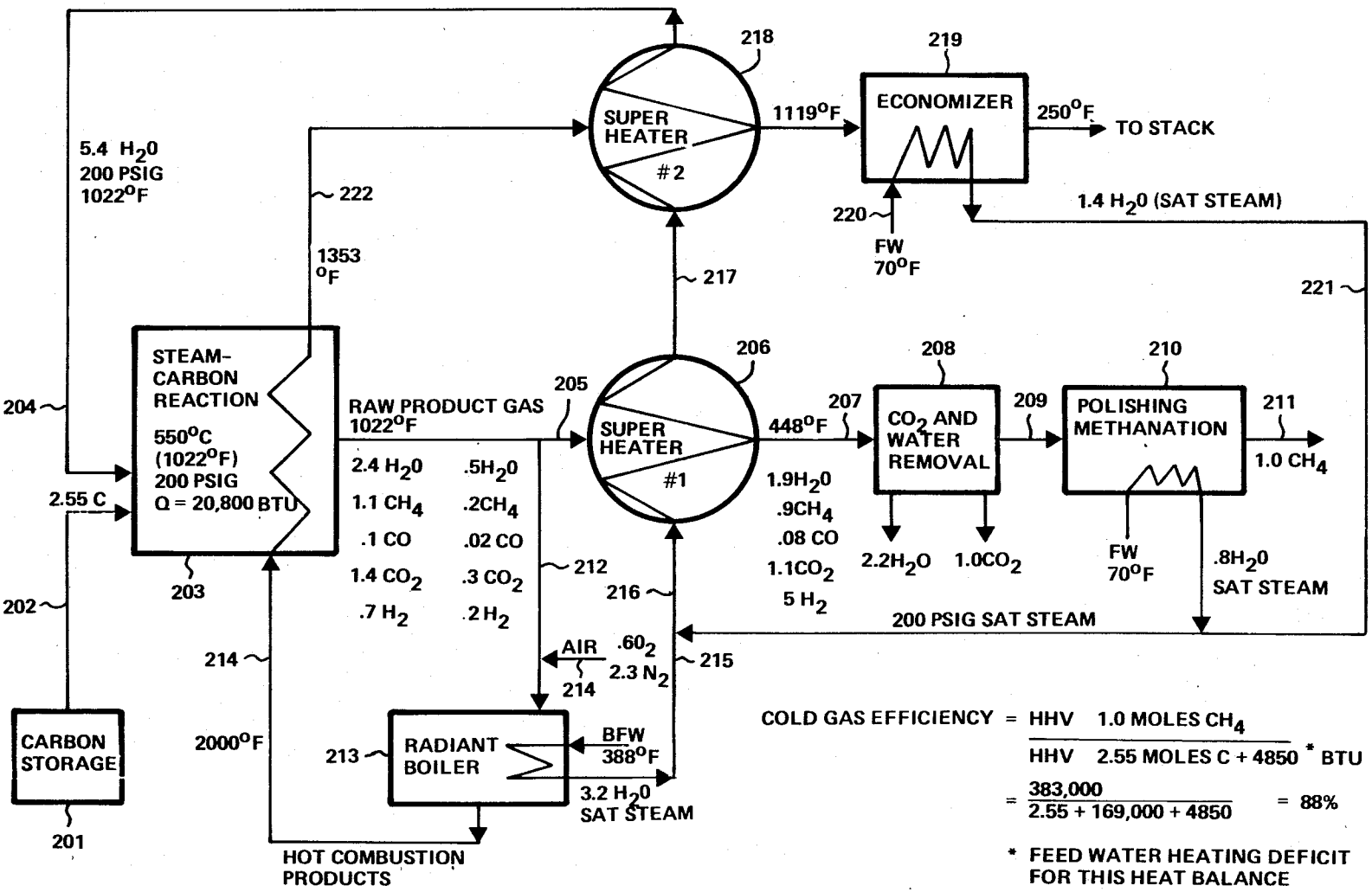

FIG. 11 shows, in block diagram, a material and heat balanced system for the conversion of our carbonaceous materials to methane, assuming steam-carbon equilibrium at 550° C. and 200 psig. Carbonaceous material passes from storage zone 201 on path 202 to reactor 203. Steam enters reactor 203 on path 204 and contacts the carbonaceous materials for production of methane, carbon monoxide, hydrogen and other gases. This gas mixture exits the reactor zone on path 205, passes through superheater 206, and then, on path 207, to zone 208 where carbon dioxide and water are removed. From zone 208, product gas passes on path 209 to polishing methanator 210, from which the product methane gas emerges on path 211.

Some of the product gas on path 205 is drawn off on path 212, passed to radiant boiler 213 in combination with air added on path 214, and then fed indirectly in pipes into reactor 203 on path 214 to provide added heat there. These gases leave reactor 203 on path 222, pass through superheater 218, and boiler 219.

What is claimed is:

1. A continuous steam gasification process for producing a high heating value gas stream containing methane and hydrogen from a low heating value fuel gas containing carbon monoxide and hydrogen comprising the steps of:

(a) reacting in a steam gasification zone a fibrous carbon-enriched carbonaceous material with steam at a temperature of from about 500° C. to about 750° C. and a pressure of from about 1 to about 100 atmospheres to gasify at least about 40% of the carbon in the fibrous carbon-enriched carbonaceous material to produce (i) a high heating value gas stream containing methane and hydrogen and (ii) a fibrous carbon-lean carbonaceous material, the fibrous carbon-enriched carbonaceous material comprising from about 55% to about 98% by weight carbon, from about 1% to about 44% by weight ferrous group metal component, and from about 0.1% to about 1% by weight hydrogen, the ferrous group metal component containing at least 70% by weight nickel, cobalt, and combinations thereof and not more than 30% by weight iron, the fibrous carbon-enriched carbonaceous material including a major phase and a minor phase, the major phase comprising from about 95% to about 99.9% by weight carbon, from about 0.1% to about 1% by weight hydrogen, and the balance, if any, being the ferrous group metal component, the minor component being nodules which are dispersed throughout the major phase and are intimately associated with and at least partly bonded to the carbon in the major phase, the minor phase comprising carbon and at least 50% by weight ferrous group metal component;

(b) withdrawing from the steam gasification zone (i) the high heating value gas stream and (ii) a solid phase consisting essentially of the fibrous carbon-lean carbonaceous material;

(c) reacting in a carbon deposition zone the withdrawn fibrous carbon-lean carbonaceous material with the low heating value fuel gas at a temperature of from about 300° to about 700° C. to deposit carbon on the fibrous carbon-lean carbonaceous material to form (i) the fibrous carbon-enriched carbonaceous material and (ii) depleted low heating value fuel gas;

(d) withdrawing from the carbon deposition zone a solid phase consisting essentially of the fibrous carbon-enriched carbonaceous material;

(e) recycling carbon-enriched carbonaceous material withdrawn from the carbon deposition zone to the steam gasification zone; and (f) lowering the temperature of the withdrawn high heating value gas stream and contacting it with the fibrous carbon-enriched carbonaceous material at a temperature of 300° to 500° C. for increasing the heating value of the high heating value gas stream.

2. The process of claim 1 in which the temperature in the steam gasification zone is from about 500° to about 600° C.

3. The process of claim 1 wherein the low heating value fuel gas is formed by burning coal with air.

4. The process of claim 1 including the step of withdrawing depleted low heating value fuel gas from the carbon deposition zone and utilizing the withdrawn low heating value fuel gas to generate electrical power or to produce steam.

5. The process of claim 1 wherein the ferrous group metal component contains substantially no iron.

6. A continuous steam gasification process for producing a high heating value gas stream containing methane and hydrogen from a low heating value fuel gas containing carbon monoxide and hydrogen comprising the steps of:

(a) reacting in a steam gasification zone a fibrous carbon-enriched carbonaceous material with steam at a temperature of from about 500° C. to about 750° C. and a pressure of from about 1 to about 100 atmospheres to gasify at least about 40% of the carbon in the fibrous carbon-enriched carbonaceous material to produce (i) a high heating value gas stream containing methane and hydrogen and (ii) a fibrous carbon-lean carbonaceous material, the fibrous carbon-enriched carbonaceous material comprising from about 55% to about 98% by weight carbon, from about 1% to about 44% by weight ferrous group metal component, and from about 0.1% to about 1% by weight hydrogen, the ferrous group metal component containing at least 70% by weight nickel, cobalt, and combinations thereof and not more than 30% by weight iron, the fibrous carbon-enriched carbonaceous material including a major phase and a minor phase, the major phase comprising from about 95% to about 99.9% by weight carbon, from about 0.1% to about 1% by weight hydrogen, and the balance, if any, being the ferrous group metal component, the minor component being nodules which are dispersed through the major phase and are intimately associated with and at least partly bonded to the carbon in the major phase, the minor phase comprising carbon and at least 50% by weight ferrous group metal component;

(b) withdrawing from the steam gasification zone (i) the high heating value gas stream and (ii) a solid phase consisting essentially of the fibrous carbon-lean carbonaceous material;

(c) reacting in a carbon deposition zone the withdrawn fibrous carbon-lean carbonaceous material with the low heating value fuel gas at a temperature of from about 300° to about 700° C. to deposit carbon on the fibrous carbon-lean carbonaceous material to form (i) the fibrous carbon-enriched carbonaceous material and (ii) depleted low heating value fuel gas;

(d) withdrawing from the carbon deposition zone a solid phase consisting essentially of the fibrous carbon-enriched carbonaceous material;

(e) recycling carbon-enriched carbonaceous material withdrawn from the carbon deposition zone to the steam gasification zone; and (f) lowering the temperature of the withdrawn high heating value gas stream and contacting it with the steam and the fibrous carbon-enriched carbonaceous material at a temperature of 300° to 500° C.

7. The process of claim 6 wherein the ferrous group metal component contains substantially no iron.

8. A continuous steam gasification process for producing a high heating value gas stream containing methane and hydrogen from a low heating value fuel gas containing carbon monoxide and hydrogen comprising:

(a) reacting in a steam gasification zone a fibrous carbon-enriched carbonaceous material with steam at a temperature of from about 500° C. to about 750° C. and a pressure of from about 1 to about 100 atmospheres to gasify at least about 40% of the carbon in the fibrous carbon-enriched carbonaceous material to produce (i) a high heating value gas stream containing methane and hydrogen and (ii) a fibrous carbon-lean carbonaceous material, the fibrous carbon-enriched carbonaceous material comprising from about 55% to about 98% by weight carbon, from about 1% to about 44% by weight ferrous group metal component, and from about 0.1% to about 1% by weight hydrogen, the ferrous group metal component containing at least 70% by weight nickel, cobalt, and combinations thereof and not more than 30% by weight iron, the fibrous carbon-enriched carbonaceous material including a major phase and a minor phase, the major phase comprising from about 95% to about 99.9% by weight carbon, from about 0.1% to about 1% by weight hydrogen, and the balance, if any, being the ferrous group metal component, the minor component being nodules which are dispersed throughout the major phase and are intimately associated with and at least partly bonded to the carbon in the major phase, the minor phase comprising carbon and at least 50% by weight ferrous group metal component;

(b) withdrawing from the steam gasification zone (i) the high heating value gas stream ad (ii) a solid phase consisting essentially of the fibrous carbon-lean carbonaceous material;

(c) reacting in a carbon deposition zone the withdrawn fibrous carbon-lean carbonaceous material with the low heating value fuel gas at a temperature of from about 300° to about 700° C. to deposit carbon on the fibrous carbon-lean carbonaceous material to form (i) the fibrous carbon-enriched carbonaceous material and (ii) depleted low heating value fuel gas;

(d) withdrawing from the carbon deposition zone a solid phase consisting essentially of the fibrous carbon-enriched carbonaceous material;

(e) recycling carbon-enriched carbonaceous material withdrawn from the carbon deposition zone to the steam gasification zone; and (f) lowering the temperature of the withdrawn high heating value gas stream and contacting it with the fibrous carbon-lean carbonaceous material at a temperature of 300° to 500° C. for increasing the heating value of the high heating value gas stream.

9. The process of claim 8 wherein the ferrous group metal component contains substantially no iron.

10. The process of claim 8 in which the temperature in the steam gasification zone is from about 500° to about 600° C.

11. The process of claim 8 wherein the low heating value fuel gas is formed by burning coal with air.

12. The process of claim 8 including the step of withdrawing depleted low heating value fuel gas from the carbon deposition zone and utilizing the withdrawn low heating value fuel gas to generate electrical power or to produce steam.

13. A continuous steam gasification process for producing a high heating value gas stream containing methane and hydrogen from a low heating value gas containing carbon monoxide and hydrogen comprising:

(a) reacting in a steam gasification zone a fibrous carbon-enriched carbonaceous material with steam at a temperature of from about 500° C. to about 750° C. and a pressure of from about 1 to about 100 atmospheres to gasify at least about 40% of the carbon in the fibrous carbon-enriched carbonaceous material to produce (i) a high heating value gas stream containing methane and hydrogen and (ii) a fibrous carbon-lean carbonaceous material, the fibrous carbon-enriched carbonaceous material comprising from about 55% to about 98% by weight carbon, from about 1% to about 44% by weight ferrous group metal component, and from about 0.1% to about 1% by weight hydrogen, the ferrous group metal component containing at least 70% by weight nickel, cobalt, and combinations thereof and not more than 30% by weight iron, the fibrous carbon-enriched carbonaceous material including a major phase and a minor phase, the major phase comprising from about 95% to about 99.9% by weight carbon, from about 0.1% to about 1% by weight hydrogen, and the balance, if any, being the ferrous group metal component, the minor component being nodules which are dispersed through the major phase and are intimately associated with and at least partly bonded to the carbon in the major phase, the minor phase comprising carbon and at least 50% by weight ferrous group metal component;

(b) withdrawing from the steam gasification zone (i) the high heating value gas stream and (ii) a solid phase consisting essentially of the fibrous carbon-lean carbonaceous material;

(c) reacting in a carbon deposition zone the withdrawn fibrous carbon-lean carbonaceous material with the low heating value fuel gas at a temperature of from about 300° to about 700° C. to deposit carbon on the fibrous carbon-lean carbonaceous material to form (i) the fibrous carbon-enriched carbonaceous material and (ii) depleted low heating value fuel gas;

(d) withdrawing from the carbon deposition zone a solid phase consisting essentially of the fibrous carbon-enriched carbonaceous material;

(e) recycling carbon-enriched carbonaceous material withdrawn from the carbon deposition zone to the steam gasification zone; and (f) lowering the temperature of the withdrawn high heating value gas stream and contacting it with steam and the fibrous carbon-lean carbonaceous material at a temperature of 300° to 500° C.

14. The process of claim 13 wherein the ferrous group metal component contains substantially no iron.

15. A continuous steam gasification process for producing a high heating value methane-rich gas stream from a low heating value fuel gas containing carbon monoxide and hydrogen comprising:

(a) reacting in a steam gasification zone a fibrous carbon-enriched carbonaceous material with steam at a temperature of from about 500° C. to about 750° C., a pressure of from about 10 to about 100 atmospheres, and a molar ratio of steam fed to carbon gasified of less than about 3 to gasify at least about 40% of the carbon in the fibrous carbon-enriched carbonaceous material to produce (i) a high heating value methane-rich gas stream and (ii) a fibrous carbon-lean carbonaceous material, the fibrous carbon-enriched material comprising from about 55% to about 98% by weight carbon, from about 1% to abut 44% by weight ferrous group metal component, and from about 0.1% to about 1% by weight hydrogen, the ferrous group metal component being selected from the group consisting of nickel, cobalt, iron, and combinations thereof, at least 70% by weight of the ferrous group metal component being nickel, the fibrous carbon-enriched carbonaceous material including a major phase and a minor phase, the major phase comprising from about 95% to about 99% by weight carbon, from about 0.1% to about 1% by weight hydrogen, and the balance, if any, being the ferrous group metal component, the minor component being nodules which are dispersed throughout the major phase and are intimately associated with and at least partly bonded to the carbon in the major phase, the minor phase comprising carbon and at least 50% by weight ferrous group metal component;

(b) withdrawing from the steam gasification zone (i) the high heating value gas stream and (ii) a solid phase consisting essentially of the fibrous carbon-lean carbonaceous material;

(c) reacting in a carbon deposition zone the withdrawn fibrous carbon-lean carbonaceous material with the low heating value fuel gas at a temperature of from about 300° to about 500° C. to deposit carbon on the fibrous carbon-lean carbonaceous material to form (i) the fibrous carbon-enriched carbonaceous material and (ii) depleted low heating value fuel gas;

(d) withdrawing from the carbon deposition zone a solid phase consisting essentially of the fibrous carbon-enriched carbonaceous material; and (e) recycling carbon-enriched carbonaceus material withdrawn from the carbon deposition zone to the steam gasification zone.

16. The process of claim 15 comprising the steps of lowering the temperature of the withdrawn high heating value gas stream and contacting it with the fibrous carbon-enriched carbonaceous material at a temperature of 300° to 500° C. for increasing the heating value of the high heating value gas stream.

17. The process of claim 15 comprising the steps of lowering the temperature of the withdrawn high heating value gas stream and contacting it with steam and the fibrous carbon-enriched carbonaceous material at a temperature of 300° to 500° C. for increasing the heating value of the high heating value gas stream.

18. The process of claim 15 comprising the steps of lowering the temperature of the withdrawn high heating value gas stream and contacting it with the fibrous carbon-lean carbonaceous material at a temperature of 300° to 500° C. for increasing the heating value of the high heating value gas stream.

19. The process of claim 15 comprising the steps of lowering the temperature of the withdrawn high heating value gas stream and contacting it with steam and the fibrous carbon-lean carbonaceous material at a temperature of 300° to 500° C. for increasing the heating value of the high heating value gas stream.

20. The process of claim 15 wherein the low heating value fuel gas is formed by burning coal with air.

21. The process of claim 15 wherein the ferrous group metal component contains substantially no iron.

22. A continuous steam gasification process for producing a high heating value hydrogen-rich gas stream from a low heating value fuel gas containing carbon monoxide and hydrogen comprising:

(a) reacting in a steam gasification zone a fibrous carbon-enriched carbonaceous material with steam at a temperature of from about 500° to about 650° C., a pressure of from about 1 to about 10 atmospheres, and a molar ratio of steam fed to carbon gasified of at least about 3 to gasify at least about 40% of the carbon in the fibrous carbon-enriched carbonaceous material to produce (i) a high heating value hydrogen-rich gas stream containing hydrogen and (ii) a fibrous carbon-lean carbonaceous material, the fibrous carbon-enriched carbonaceous material comprising from about 55% to about 98% by weight carbon, from about 1% to about 44% by weight ferrous group metal component, and from about 0.1% to about 1% by weight hydrogen, the ferrous group metal component being selected from the group consisting of nickel, cobalt, iron, and combinations thereof, at least 70% by weight of the ferrous group metal component being cobalt, the fibrous carbon-enriched carbonaceous material including a major phase and a minor phase, the major phase comprising from about 95% to about 99.9% by weight carbon, from about 0.1 to about 1% by weight hydrogen, and the balance, if any, being the ferrous group metal component, the minor component being nodules which are dispersed throughout the major phase and are intimately associated with and at least partly bonded to the carbon in the major phase, the minor phase comprising carbon and at least 50% by weight ferrous group metal component;

(b) withdrawing from the steam gasification zone (i) the high heating value gas stream and (ii) a solid phase consisting essentially of the fibrous carbon-lean carbonaceous material;

(c) reacting in a carbon deposition zone the withdrawn fibrous carbon-lean carbonaceous material with the low heating value fuel gas at a temperature of above about 550° C. to deposit carbon on the fibrous carbon-lean carbonaceous material to form (i) the fibrous carbon-enriched carbonaceous material and (ii) depleted low heating value fuel gas;

(d) withdrawing from the carbon deposition zone a solid phase consisting essentially of the fibrous carbon-enriched carbonaceous material; and (e) recycling carbon-enriched carbonaceous material withdrawn from the carbon deposition zone to the steam gasification zone.

23. The process of claim 22 comprising the steps of lowering the temperature of the withdrawn high heating value gas stream and contacting it with the fibrous carbon-enriched carbonaceous material at a temperature of 300° to 500° C. for increasing the heating value of the high heating value gas stream.

24. The process of claim 22 comprising the steps of lowering the temperature of the withdrawn high heating value gas stream and contacting it with steam and the fibrous carbon-enriched carbonaceous material at a temperature of 300° to 500° C. for increasing the heating value of the high heating value gas stream.

25. The process of claim 22 comprising the steps of lowering the temperature of the withdrawn high heating value gas stream and contacting it with the fibrous carbon-lean carbonaceous material at a temperature of 300° to 500° C. for increasing the heating value of the high heating value gas stream.

26. The process of claim 22 comprising the steps of lowering the temperature of the withdrawn high heating value gas stream and contacting it with steam and the fibrous carbon-lean carbonaceous material at a temperature of 300° to 500° C. for increasing the heating value of the high heating value gas stream.

27. The process of claim 22 wherein the low heating value fuel gas is formed by burning coal with air.

28. The process of claim 22 wherein the ferrous group metal component comprises iron.

29. The process of claim 28 in which the ferrous group metal component comprises up to 10% by weight iron.

30. The process of claim 22 wherein the ferrous group metal component contains substantially no iron.

* * * * *